US005799669A

United States Patent [19]

Briggs

[11] Patent Number: 5,799,669

[45] Date of Patent: Sep. 1, 1998

[54] APPARATUS AND METHOD FOR CREATING HAIR COLORING DESIGNS

[76] Inventor: Blanca Flor Briggs, 1007 E. Las Olas Blvd., Fort Lauderdale, Fla. 33301

[21] Appl. No.: 925,995

[22] Filed: Sep. 9, 1997

[51] Int. Cl.[6] ..... A45D 19/18

[52] U.S. Cl. ..... 132/208; 132/270; 132/222

[58] Field of Search ..... 132/208, 207, 132/270, 22

[56] References Cited

U.S. PATENT DOCUMENTS

| | | | |
|---|---|---|---|
| 3,433,232 | 3/1969 | Garrett | 132/208 |
| 3,599,647 | 8/1971 | Fabbri | 131/9 |
| 4,224,954 | 9/1980 | Stahl . | |
| 4,658,840 | 4/1987 | McCosker | 132/208 |
| 5,056,539 | 10/1991 | Abramson | 132/270 |
| 5,287,864 | 2/1994 | Gallo | 132/208 |
| 5,349,970 | 9/1994 | Razzouq | 132/208 |
| 5,433,225 | 7/1995 | Liggett | 132/208 |
| 5,469,873 | 11/1995 | Guth | 132/270 |
| 5,588,449 | 12/1996 | Falcon | 132/208 |
| 5,664,590 | 9/1997 | Plateroti et al. | 132/270 |

FOREIGN PATENT DOCUMENTS

| | | | |
|---|---|---|---|
| 2277681 | 11/1994 | United Kingdom | 132/208 |

*Primary Examiner*—Todd E. Manahan
*Attorney, Agent, or Firm*—Oltman, Flynn & Kubler

[57] ABSTRACT

An apparatus and method for creating hair coloring designs comprising a main body with a substantially thin, foldable, sheet-like configuration and including a base portion with an outer face and an opposite inner face having an adhesive material thereon, a pattern portion with an outer face, an opposite inner face having an adhesive material thereon and at least one hole of a desired geometric shape cut therethrough, an intermediate portion with a laterally disposed slit between the base portion and the pattern portion, and a peel-off strip of material structured and disposed to cover the adhesive material. The main body is formed from a substantially liquid impermeable material, such as aluminum foil. In use, the main body is positioned over a strand of hair so that the outer face of the base portion is in substantially direct contact with the strand of hair in overlying relation thereto and the strand of hair is pulled through the slit. The peel-off strip of material over the inner face of the base portion is then removed and the strand of hair uniformly distributed longitudinally across the adhesive material on the inner face of the base portion. The peel-off strip of material over the inner face of the pattern portion is then removed and the pattern portion folded over the base portion. A coloring agent is then inserted through the holes and the exposed portions of the strand of hair colored.

10 Claims, 5 Drawing Sheets

APPARATUS AND METHOD FOR CREATING HAIR COLORING DESIGNS

BACKGROUND OF THE INVENTION

1. Field of the Invention

The present invention relates to an apparatus and method for coloring hair and, more particularly, to an apparatus and method for creating hair coloring designs.

2. Description of the Related Art

Over the years, hair styling has taken on greater importance to both men and women. A predominant aspect of this styling process is the color of ones hair. For many years, people have been changing the color of their hair or adding streaks or highlights to their hair in an effort to obtain a certain look. Today, millions of people have their hair colored or highlighted on a regular basis.

Recently, many people have gone even further than the mere coloring or highlighting of their hair. People often feel the need to make a statement, fashion or otherwise, or to just be outrageous. As such, it is not uncommon these days to see people with words, designs or patterns colored into their hair.

Several devices have been developed to assist in coloring or highlighting hair. For instance, devices disclosed in U.S. Pat. Nos. 5,287,864, 4,224,954, 5,349,970, 5,433,225, 5,469,873 and 5,056,539 employ various means to color and highlight hair. Although these devices may be useful for their intended purposes, none of these devices considered the need to create designs or patterns with colors and, therefore, none provide the ability to do so.

One device has, however, been developed with the intent and purpose to create colored designs or patterns in hair. U.S. Pat. No. 3,599,647 discloses a hair treating apparatus having a backing member with one or more ribs or projections comprising a specific geometric shape and a masking member with one or more apertures corresponding in size and shape with the geometric shape of the ribs or projections on the backing member. In use, a strand of hair, or a hair "passee" is first combed out and uniformly distributed across the top of the backing member. The masking member is then pressed down on top of the hair and backing member so that the ribs or projections push a portion of the hair out through the apertures in the masking member. The portions of the hair extending out through the apertures are then colored to create the desired colored designs or patterns.

Although this prior art reference is useful for its intended purposes, it has not proven to be entirely satisfactory. Specifically, the device does not include any type of adhesive substance on the backing member to hold the hair in place while manipulating the various members. Additionally, the device is comprised of two separate members. Consequently, the device requires that the hair be carefully held in place over the backing member while the stylist or colorist reaches for the masking member and carefully places the masking member on top of the hair and backing member so as to not disturb the uniform distribution of the hair on top of the backing member. This process is cumbersome and tedious and often requires that the various steps be repeated over and over until the hair is properly positioned and secured within the members, something that many stylists or colorists will not take the time to do. Thus, this device often results in blotchy colored designs and patterns.

Accordingly, there is still a need in the art for an apparatus and method for creating hair coloring designs which will result in uniform colored designs and patterns. Any such device should be inexpensive and simple to use. The present invention is particularly suited to overcome those problems which remain in the art in a manner not previously known.

SUMMARY OF THE INVENTION

The present invention is directed towards a new and improved apparatus and method for creating hair coloring designs which results in uniform colored designs and patterns and which is inexpensive and simple to use. The apparatus includes a main body having a substantially thin, foldable, sheet-like configuration and including a base portion, a pattern portion with at least one hole of a desired geometric shape cut therethrough, and an intermediate portion with a laterally disposed slit between the base portion and the pattern portion. The main body is formed from a substantially liquid impermeable material, such as aluminum foil. The base and pattern portions each include an outer face and an opposite inner face. The inner faces each include an adhesive material thereon. A peel-off strip of material covers the adhesive material. The base, pattern, and intermediate portions are structured and disposed so that the main body may be folded at the intermediate portion causing the inner face of the pattern portion to be in substantially direct contact with the inner face of the base portion in overlying relation thereto. In use, the main body is positioned over a strand of hair so that the outer face of the base portion is in substantially direct contact with the strand of hair in overlying relation thereto and the strand of hair is pulled through the slit. The peel-off strip of material over the inner face of the base portion is then removed and the strand of hair uniformly distributed longitudinally across the adhesive material on the inner face of the base portion. The peel-off strip of material over the inner face of the pattern portion is then removed and the pattern portion folded over the base portion. A coloring agent is then inserted through the holes and the exposed portions of the strand of hair colored. After the coloring agent has dried, the pattern portion is peeled off of the base portion and the strand of hair is removed from the adhesive material and pulled through the slit. The above steps may be repeated for other selected strands of hair.

It is an object of the present invention to provide a new and improved apparatus and method for creating hair coloring designs.

It is another object of the present invention to provide an apparatus and method for creating hair coloring designs which results in uniform colored designs and patterns.

It is also an object of the present invention to provide an apparatus and method for creating hair coloring designs which is inexpensive and simple to use.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
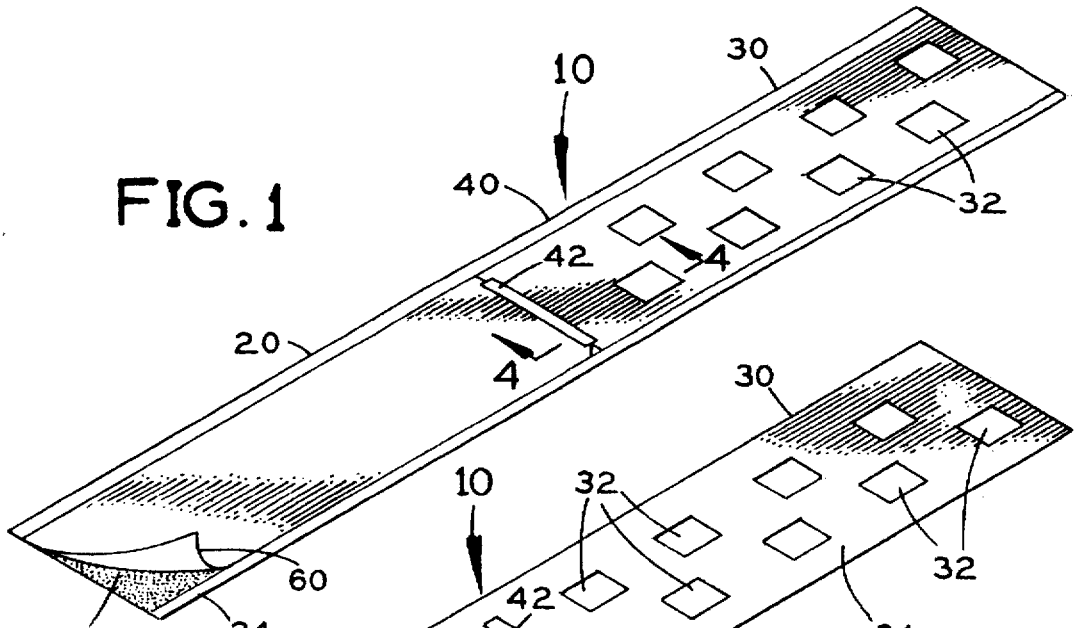
FIG. 1 is a top perspective view of the present invention with a plurality of holes having a square geometric shape showing the peel-off strip of material and adhesive material on the inner face of the main body.
Figure 2:
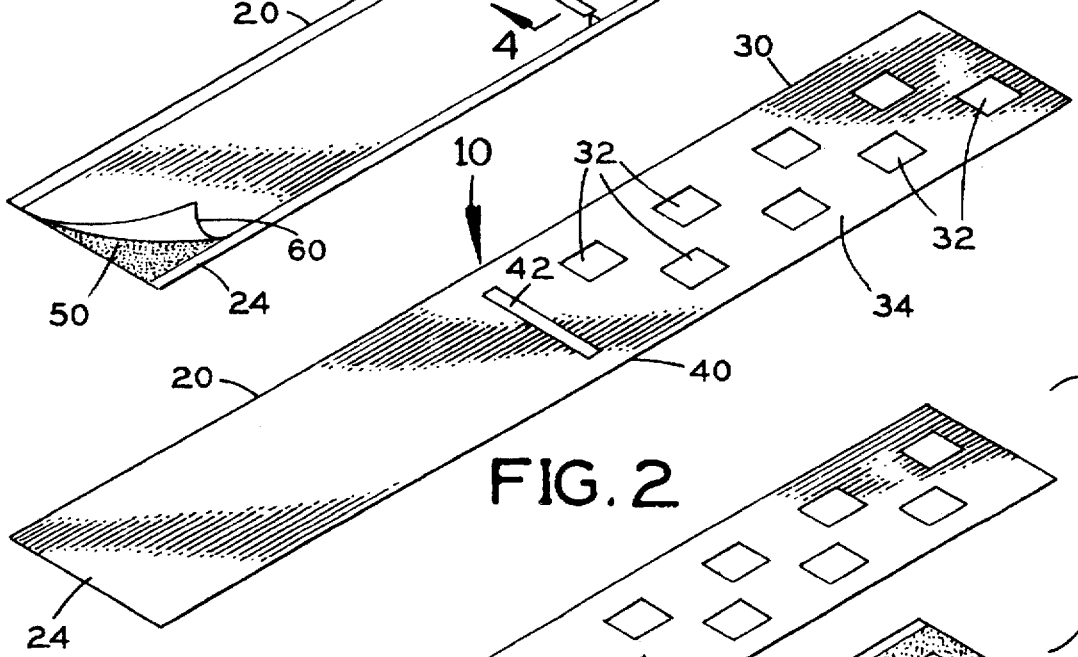
FIG. 2 is a bottom perspective view of the present invention with a plurality of holes having a square geometric shape.
Figure 3:
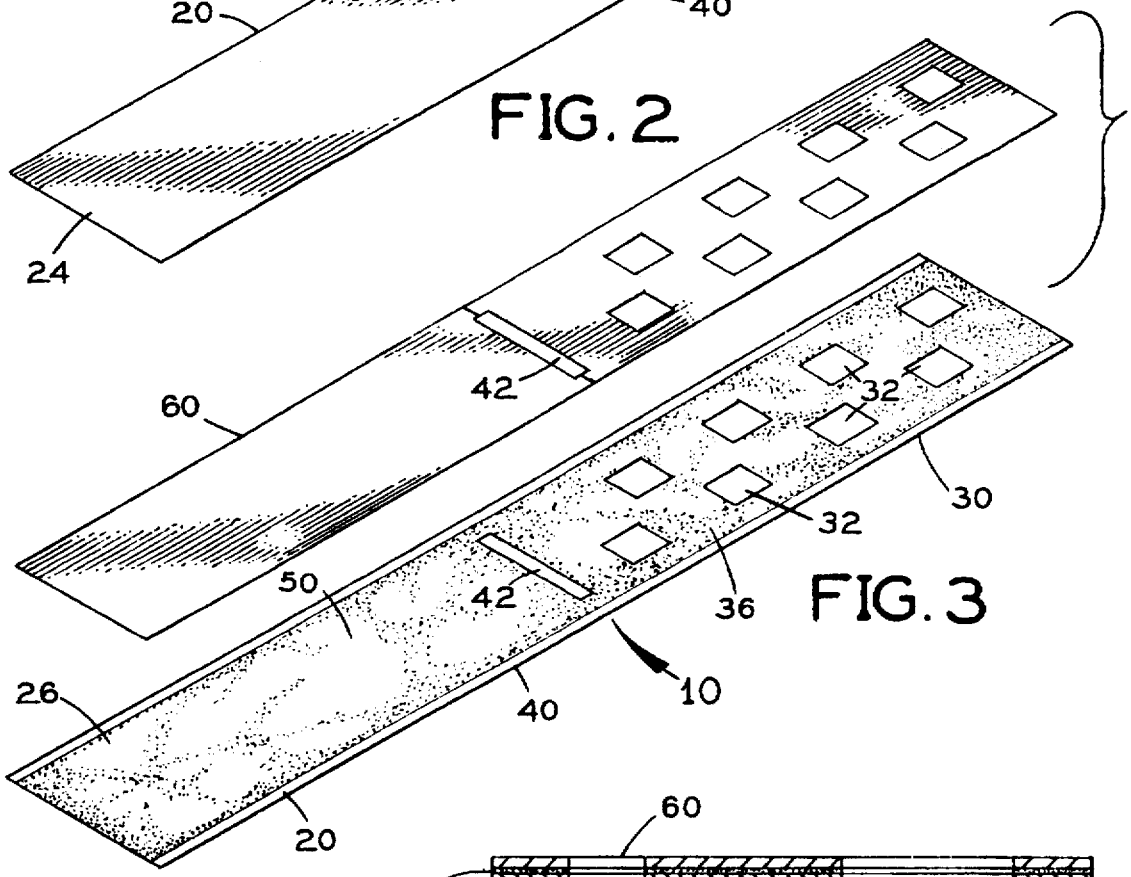
FIG. 3 is a top perspective view of the present invention with a plurality of holes having a square geometric shape showing the peel-off strip of material removed from the adhesive material on the inner face of the main body.
Figure 4:
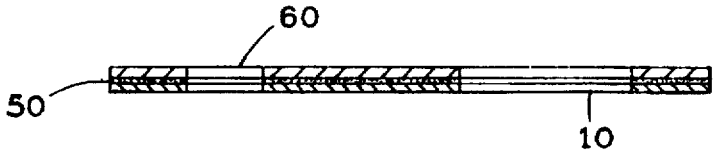
FIG. 4 is a cross sectional view of the present invention of FIG. 1, taken across the line 4—4, showing the main body, the peel-off strip of material and the adhesive material therebetween.

As shown in FIGS. 1–8, the present invention is directed towards a new and improved apparatus for creating hair coloring designs which results in uniform colored designs and patterns and which is inexpensive and simple to use. The apparatus includes a main body 10 having a generally rectangular, substantially thin, foldable, sheet-like configuration. The main body 10 is preferably formed from aluminum foil, but may be constructed of any other suitable substantially liquid impermeable material. The length of the main body 10 may vary to accommodate hair of various lengths. The main body 10 includes a base portion 20, a pattern portion 30 with at least one hole of a desired geometric shape cut therethrough 32, and an intermediate portion 40 with a laterally disposed slit 42 between the base portion 20 and the pattern portion 30. The holes 32 may be squares, circles, rectangles or any other geometric shape or design.

Figure 18:
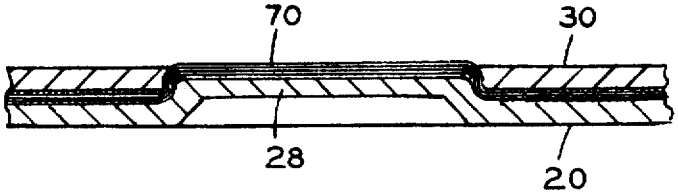
FIG. 18 is a cross sectional view of the present invention showing the raised portion of the base portion forcing the strand of hair up through the hole in the pattern portion.

Additionally, as shown in FIG. 18, the base portion 20 may include a number of raised portions 28 on the inner face 26 equal to the number of holes 32 in the pattern portion 30. The raised portions 28 are configured to correspond to the geometric shape of the holes 32 and disposed to protrude through the holes 32 when the pattern portion 30 is folded over the base portion 20.

Figure 5:
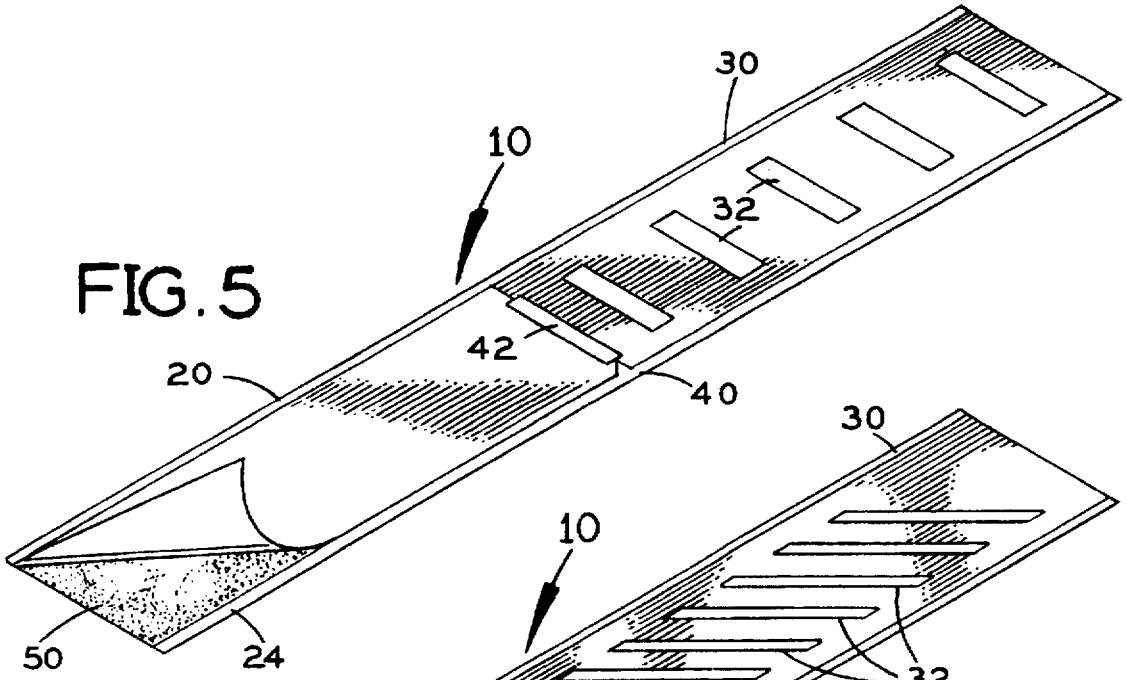
FIG. 5 is a top perspective view of the present invention with a plurality of holes having a rectangular geometric shape showing the peel-off strip of material and adhesive material on the inner face of the main body.
Figure 6:
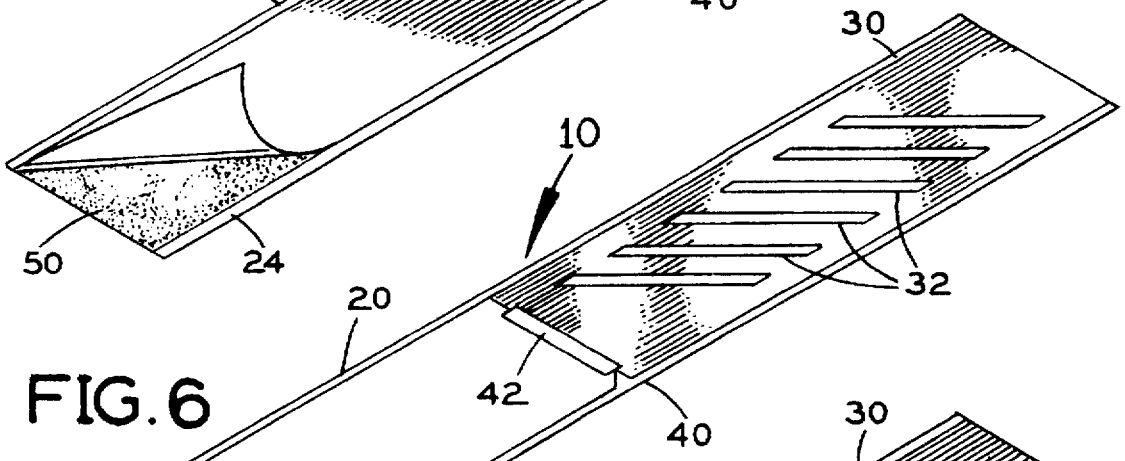
FIG. 6 is a top perspective view of the present invention with a plurality of holes having a diagonally disposed rectangular geometric shape.
Figure 7:
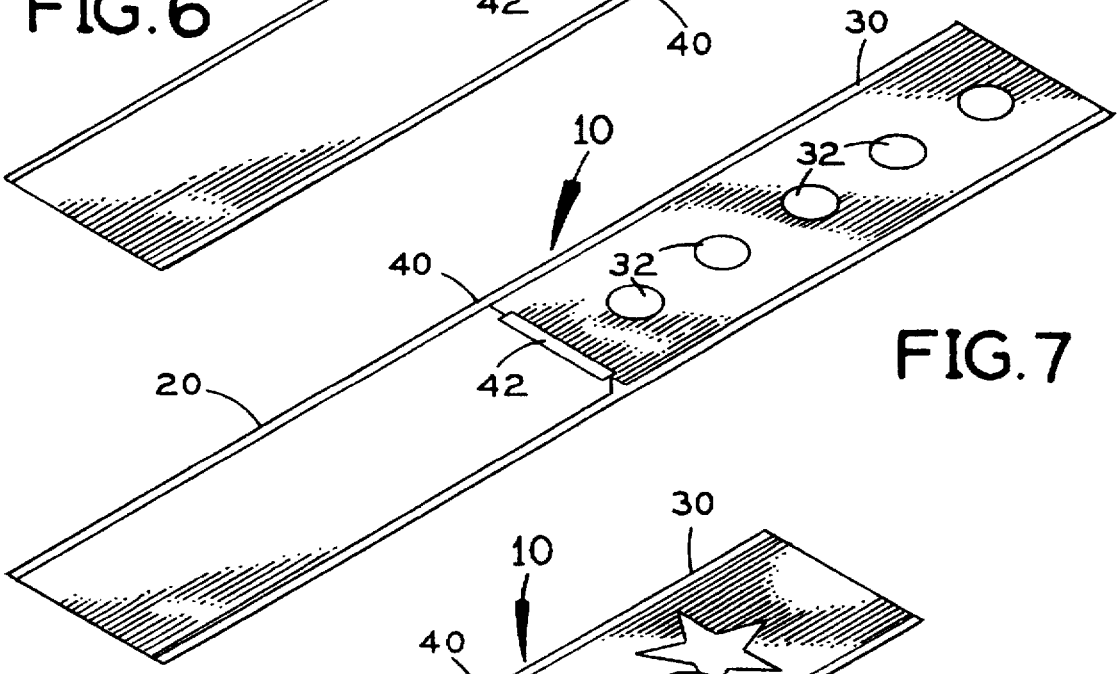
FIG. 7 is a top perspective view of the present invention with a plurality of holes having a circular geometric shape.
Figure 8:
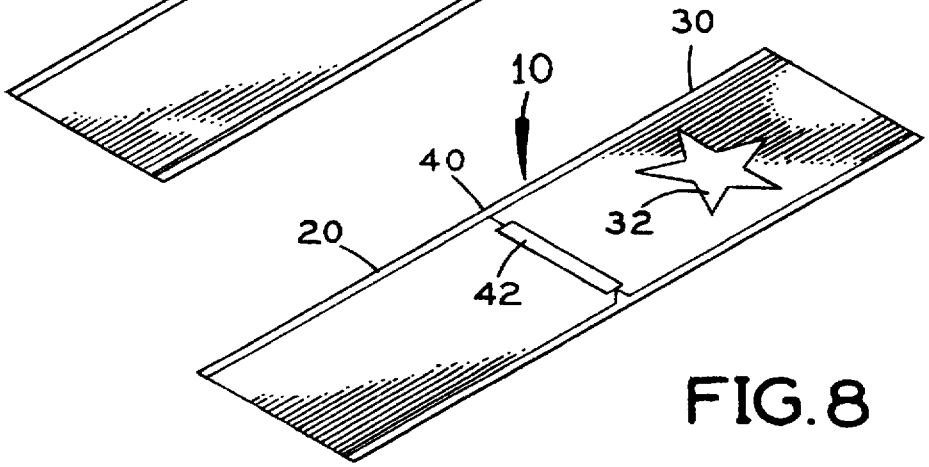
FIG. 8 is a top perspective view of the present invention with a plurality of holes having a star shaped geometric shape and a shortened main body for use with short hair.
Figure 9:
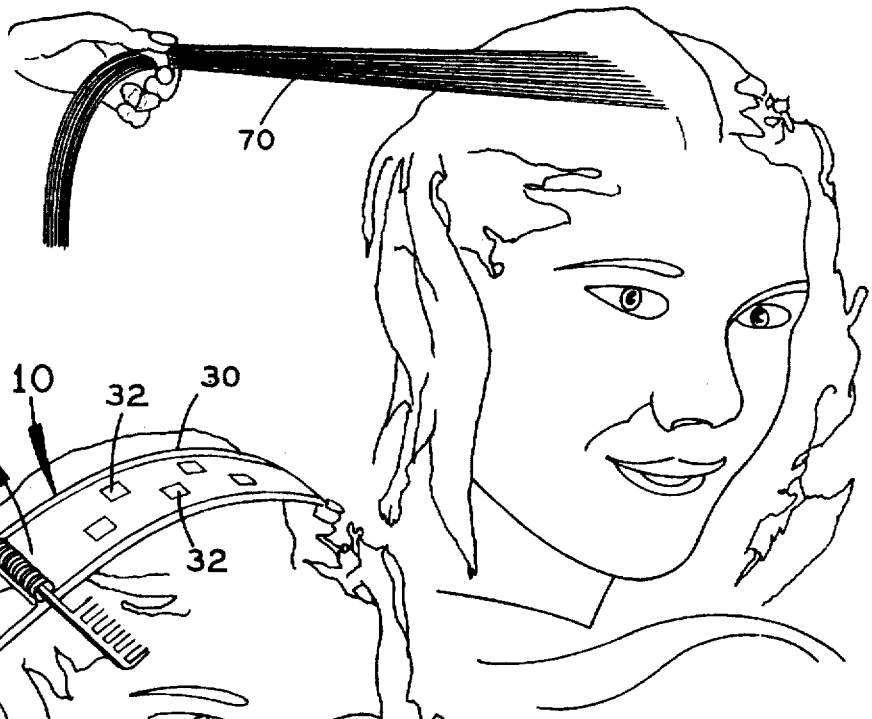
FIG. 9 is a front perspective view showing the step of grasping the strand of hair.
Figure 10:
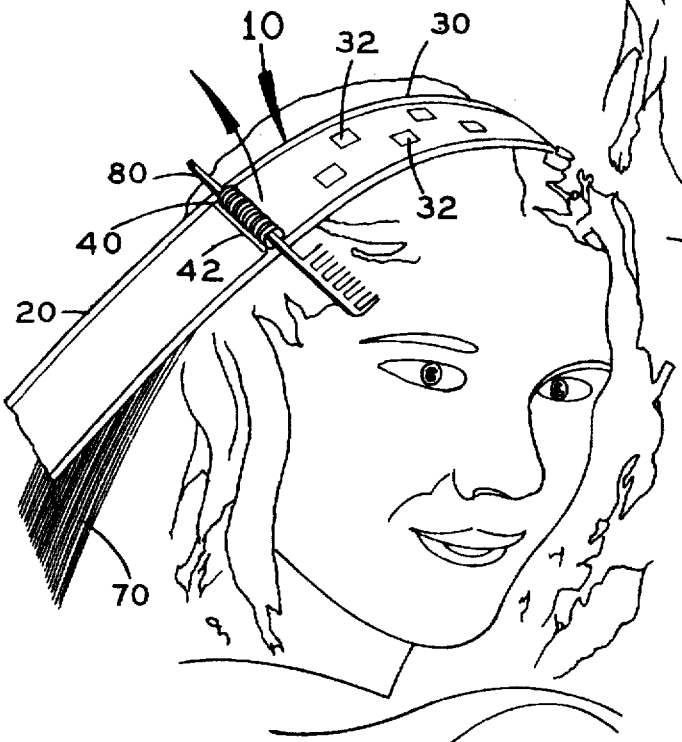
FIG. 10 is a front perspective view showing the step of pulling the strand of hair through the slit with the comb tail.
Figure 11:
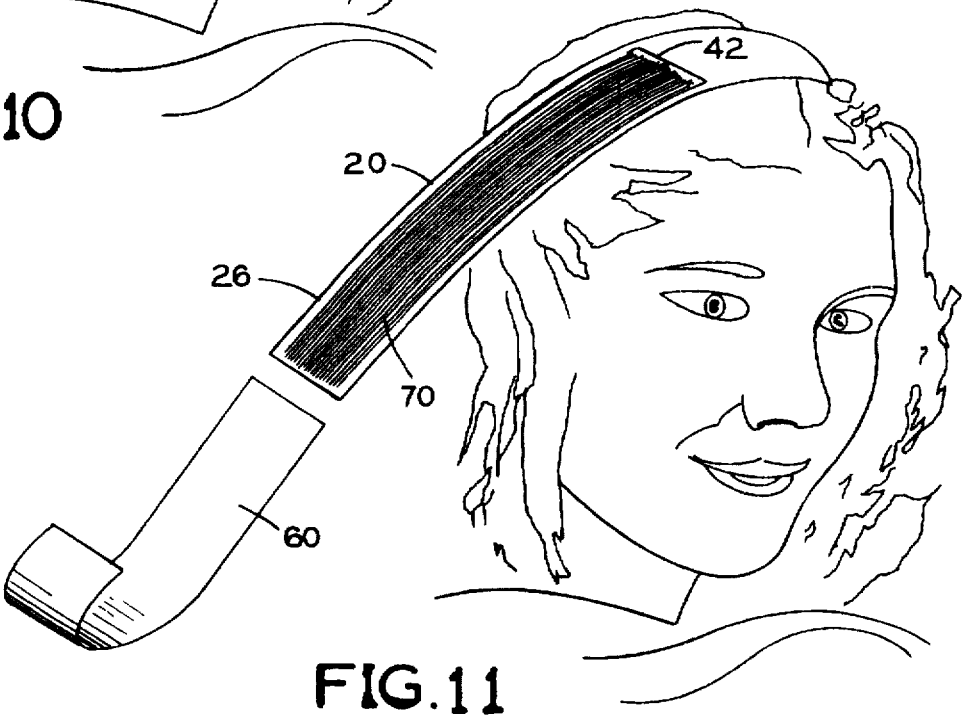
FIG. 11 is a front perspective view showing the steps of removing the peel-off strip of material from the inner face of the base portion and uniformly distributing the strand of hair longitudinally across the adhesive material on the inner face of the base portion.
Figure 12:
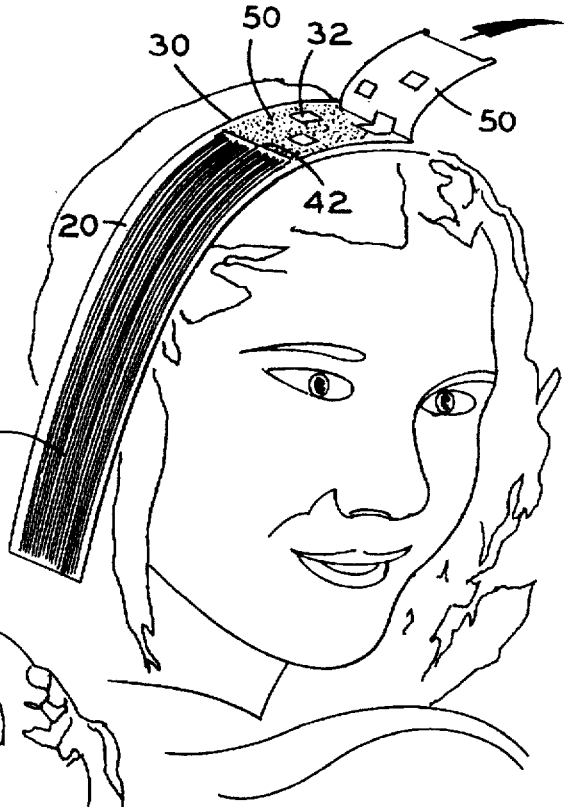
FIG. 12 is a front perspective view showing the steps of removing the peel-off strip of material from the inner face of the pattern portion.
Figure 13:
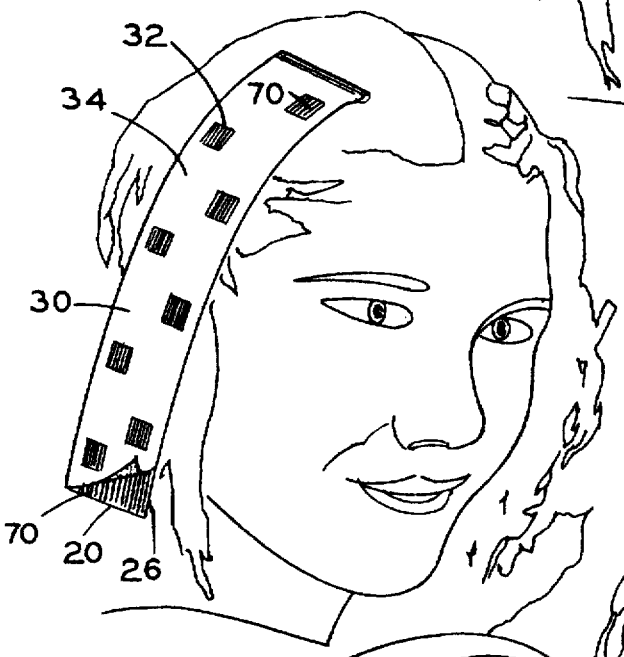
FIG. 13 is a front perspective view showing the step of folding the pattern portion over the base portion so that the strand of hair is secured between the adhesive material on the inner face of the base portion and the adhesive material on the inner face of the pattern portion.
Figure 14:
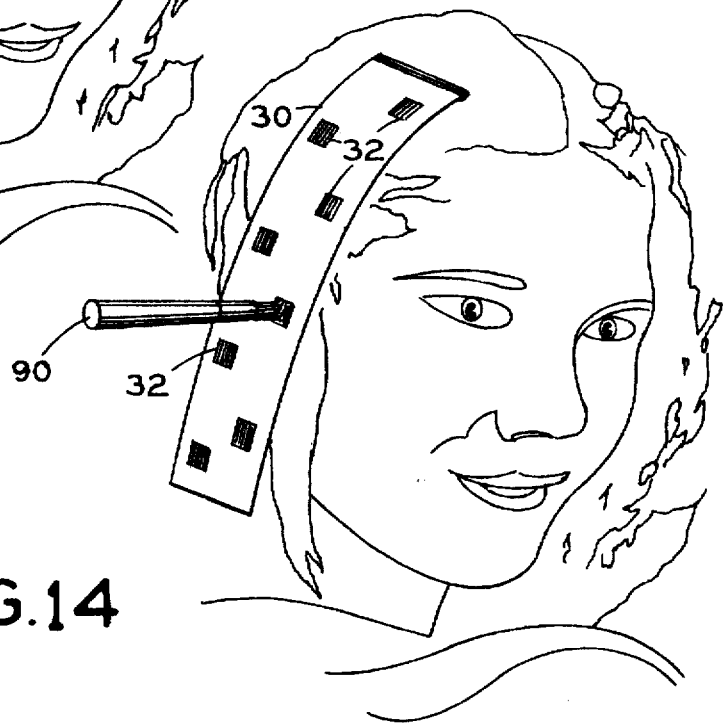
FIG. 14 is a front perspective view showing the step of inserting a coloring agent through the holes and coloring the exposed portions of the strand of hair.
Figure 15:
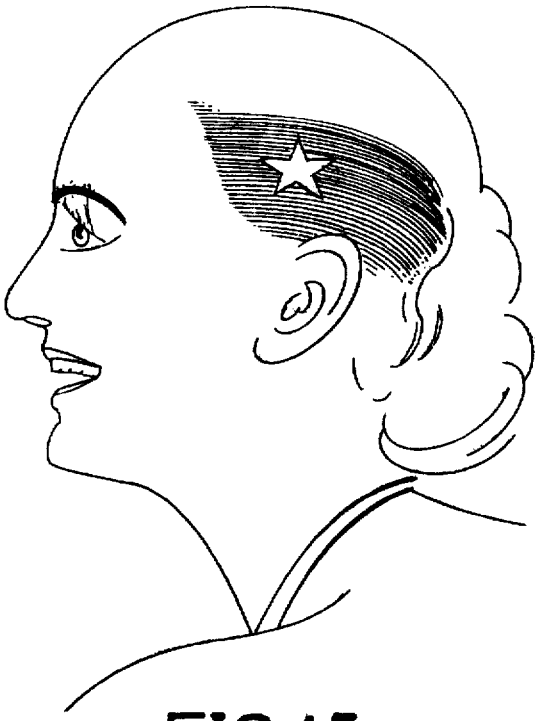
FIG. 15 is a side plan view of a persons head showing the colored design thereon.
Figure 16:
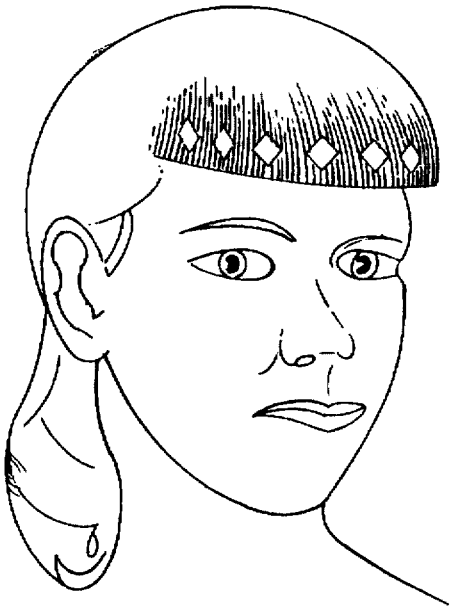
FIG. 16 is a front perspective view of a persons head showing the colored design thereon.
Figure 17:
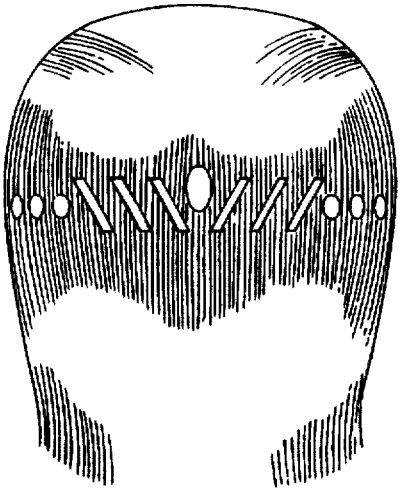
FIG. 17 is a rear plan view of a persons head showing the colored design thereon.

In the preferred embodiment, the base 20 and pattern 30 portions are of generally equal size and shape. The base 20 and pattern 30 portions each include an outer face 24, 34 and an opposite inner face 26, 36. The inner faces 26, 36 each include an adhesive material thereon 50. The adhesive material 50 is preferably glue, but may be any other suitable material. As shown in FIGS. 1 and 5, a peel-off strip of material 60 covers the adhesive material 50. The peel-off strip of material 60 is preferably constructed of paper, but may be constructed of any other suitable material.

The base 20, pattern 30, and intermediate 40 portions are structured and disposed so that the main body 10 may be folded at the intermediate portion 40 causing the inner face 36 of the pattern portion 30 to be in substantially direct contact with the inner face 26 of the base portion 20 in overlying relation thereto.

Referring now to FIGS. 9–17, in use, the main body 10 is positioned over a strand of hair 70 so that the outer face 24 of the base portion 20 is in substantially direct contact with the strand of hair 70 in overlying relation thereto and the slit 42 is adjacent the roots of the strand of hair 70. The strand of hair 70 is then pulled through the slit 42 by inserting a comb tail 80 through the slit 42 and under the strand of hair 70 and pulling the strand of hair 70 through the slit 42 with the comb tail 80.

The peel-off strip of material 60 over the inner face 26 of the base portion 20 is then removed and the strand of hair 70 uniformly distributed longitudinally across the adhesive material 50 on the inner face 26 of the base portion 20. The peel-off strip of material 60 over the inner face 36 of the pattern portion 30 is then removed and the pattern portion 30 folded over the base inner face 36 of the pattern portion 30 is then removed and the pattern portion 30 folded over the base portion 20 so that the strand of hair 70 is secured between the adhesive material 50 on the inner face 26 of the base portion 20 and the adhesive material 50 on the inner face 36 of the pattern portion 30.

A coloring agent 90 is then inserted through the holes 32 and the exposed portions of the strand of hair 70 colored. After the coloring agent 90 has dried, the pattern portion 30 is peeled off of the base portion 20 and the strand of hair 70 is removed from the adhesive material 50 and pulled through the slit 42. The above steps may be repeated for other selected strands of hair.

Upon completion of the hair coloring process, the hair is washed and styled as desired.

Various changes may be made within the spirit and scope of the invention as described above.

What is claimed is:

1. An apparatus for creating hair coloring designs comprising:

a main body having a substantially thin, foldable, sheet-like configuration and including a base portion, a pattern portion with at least one hole of a desired geometric shape cut therethrough, and an intermediate portion with a laterally disposed slit between said base portion and said pattern portion;

said main body being formed from a substantially liquid impermeable material;

said base portion and said pattern portion each having an outer face and an opposite inner face, said inner faces each having an adhesive material thereon;

a peel-off strip of material structured and disposed to cover said adhesive material; and whereby said base portion, said pattern portion and said intermediate portion are structured and disposed so that said main body may be folded at said intermediate portion causing said inner face of said pattern portion to be in substantially direct contact with said inner face of said base portion in overlying relation thereto.

2. An apparatus for creating hair coloring designs as recited in claim 1 wherein said liquid impermeable material is aluminum foil.

3. An apparatus for creating hair coloring designs as recited in claim 1 wherein said desired geometric shape is a square.

4. An apparatus for creating hair coloring designs as recited in claim 1 wherein said desired geometric shape is a circle.

5. An apparatus for creating hair coloring designs as recited in claim 1 wherein said desired geometric shape is a rectangle.

6. An apparatus for creating hair coloring designs as recited in claim 1 wherein said desired geometric shape is a star.

7. An apparatus for creating hair coloring designs as recited in claim 1 wherein said adhesive material is glue.

8. An apparatus for creating hair coloring designs as recited in claim 1 wherein said main body further includes a number of raised portions on said inner face of said base portion equal to the number of said holes on said pattern portion, said raised portions being configured to correspond to said desired geometric shape and disposed to protrude through said holes when said pattern portion is folded over said base portion.

9. A method for creating hair coloring designs using an apparatus having a main body with a substantially thin, foldable, sheet-like configuration and including a base portion with an outer face and an opposite inner face having an adhesive material thereon, a pattern portion with an outer face, an opposite inner face having an adhesive material thereon and at least one hole of a desired geometric shape cut therethrough, an intermediate portion with a laterally disposed slit between said base portion and said pattern portion, and a peel-off strip of material structured and disposed to cover said adhesive material comprising the steps of:

a. selecting and grasping a strand of hair to be colored;

b. positioning said main body over said strand of hair so that said outer face of said base portion is in substantially direct contact with said strand of hair in overlying relation thereto and said slit is adjacent the roots of said strand of hair;

c. pulling said strand of hair through said slit;

d. removing said peel-off strip of material over said inner face of said base portion, thereby exposing said adhesive material thereon;

e. uniformly distributing said strand of hair longitudinally across said adhesive material on said inner face of said base portion;

f. removing said peel-off strip of material over said inner face of said pattern portion, thereby exposing said adhesive material thereon;

g. folding said pattern portion over said base portion so that said strand of hair is secured between said adhesive material on said inner face of said base portion and said adhesive material on said inner face of said pattern portion;

h. inserting a coloring agent through said at least one hole of said desired geometric shape, thereby coloring said strand of hair exposed therethrough;

i. allowing said coloring agent to dry for a selected period of time;

j. peeling said pattern portion off of said base portion;

k. removing said strand of hair from said adhesive material;

l. pulling said strand of hair through said slit;

m. removing said main body; and n. repeating steps a through m for selected strands of hair.

10. A method for creating hair coloring designs as recited in claim 9 wherein said pulling said strand of hair through said slit is accomplished by inserting a comb tail through said slit and under said strand of hair and pulling said strand of hair through said slit with said comb tail.

* * * * *